US005406763A

United States Patent [19]

Al-Saleh

[11] Patent Number: 5,406,763

[45] Date of Patent: Apr. 18, 1995

[54] TILING NETWORKS WITH GEOMETRICAL AND ORNAMENTAL PATTERNS

[76] Inventor: Abdul A. A. Al-Saleh, P.O. Box 21952, Riyadh 11485, Saudi Arabia

[21] Appl. No.: 208,083

[22] Filed: Mar. 8, 1994

Related U.S. Application Data

[63] Continuation of Ser. No. 939,456, Sep. 1, 1992, abandoned.

[51] Int. Cl.[6] ..... E04F 15/14

[52] U.S. Cl. ..... 52/311.1; 52/318; 52/743

[58] Field of Search ..... 404/31, 50; 52/311.1, 52/318, 743

[56] References Cited

U.S. PATENT DOCUMENTS

| | | | |
|---|---|---|---|
| 178,308 | 6/1876 | Leathers et al. . | |
| 507,430 | 10/1893 | Graham | 52/509 |
| 616,759 | 12/1898 | Adams | 404/70 |
| 1,457,999 | 6/1923 | Pedersen . | |
| 1,539,148 | 5/1925 | Sylvester | 52/311.1 |
| 1,539,988 | 6/1925 | Bowman | 52/743 |
| 1,557,723 | 10/1925 | Pearson | 249/83 |
| 1,633,328 | 6/1927 | Hinton | 249/83 |
| 1,645,622 | 10/1927 | Prince | 404/70 |
| 1,689,164 | 10/1928 | Sylvester | 52/318 |
| 1,742,855 | 1/1930 | Galassi | 404/21 |
| 2,025,576 | 12/1935 | De Spirt | 52/365 |
| 2,045,936 | 6/1936 | Wieger | 52/318 |
| 2,081,249 | 2/1936 | Bowman | 52/318 |
| 2,616,145 | 11/1952 | Dufford . | |
| 2,819,495 | 1/1958 | Krausz . | |
| 3,398,497 | 8/1968 | Hellmich et al. | 52/665 |
| 3,683,581 | 8/1972 | Yamaso | 52/666 |
| 3,703,307 | 11/1972 | Curtis | 52/665 |
| 4,665,673 | 5/1987 | Diana | 52/314 |

FOREIGN PATENT DOCUMENTS

| | | | |
|---|---|---|---|
| 332045 | 8/1903 | France | 52/633 |
| 1144404 | 4/1957 | France | 52/318 |
| 2314982 | 1/1977 | France | 52/668 |
| 616850 | 2/1961 | Italy | 52/318 |
| 200582 | 2/1939 | Switzerland | 52/550 |
| 332741 | 9/1930 | United Kingdom | 404/50 |

*Primary Examiner*—James L. Ridgill, Jr.
*Attorney, Agent, or Firm*—David M. Klein; Bryan Cave

[57] ABSTRACT

This invention relates to an apparatus and method for creating tiling networks with geometrical and ornamental patterns and designs without using tile. The networks consist of units which may be manufactured in whatever patterns or designs that are desired. The network units are pre-manufactured to form the required ornamental pattern or design and may be assembled on site on a level surface. When assembled, a series of cavities are created. The cavities are divided by the walls of the network units. The top surface of the walls of the network units are an integral component of the pattern or design created. The cavities and the patterns formed by the top surfaces of the network units comprise the ornamental pattern or design. The cavities are filled with a material in order to make the ornamental surface relatively level. The cavities may be filled with materials of different colors to enhance the pattern or design. Additionally, the walls of the network units may be made of different materials and different colors.

2 Claims, 17 Drawing Sheets

FIG. 28
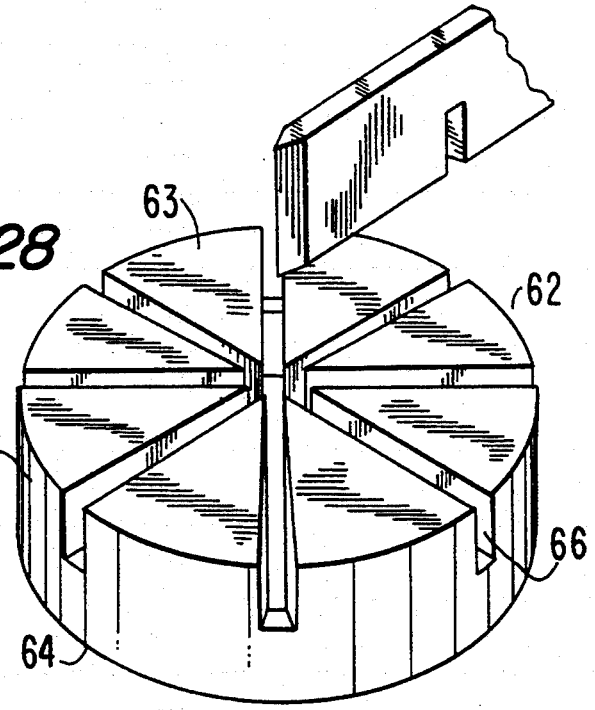
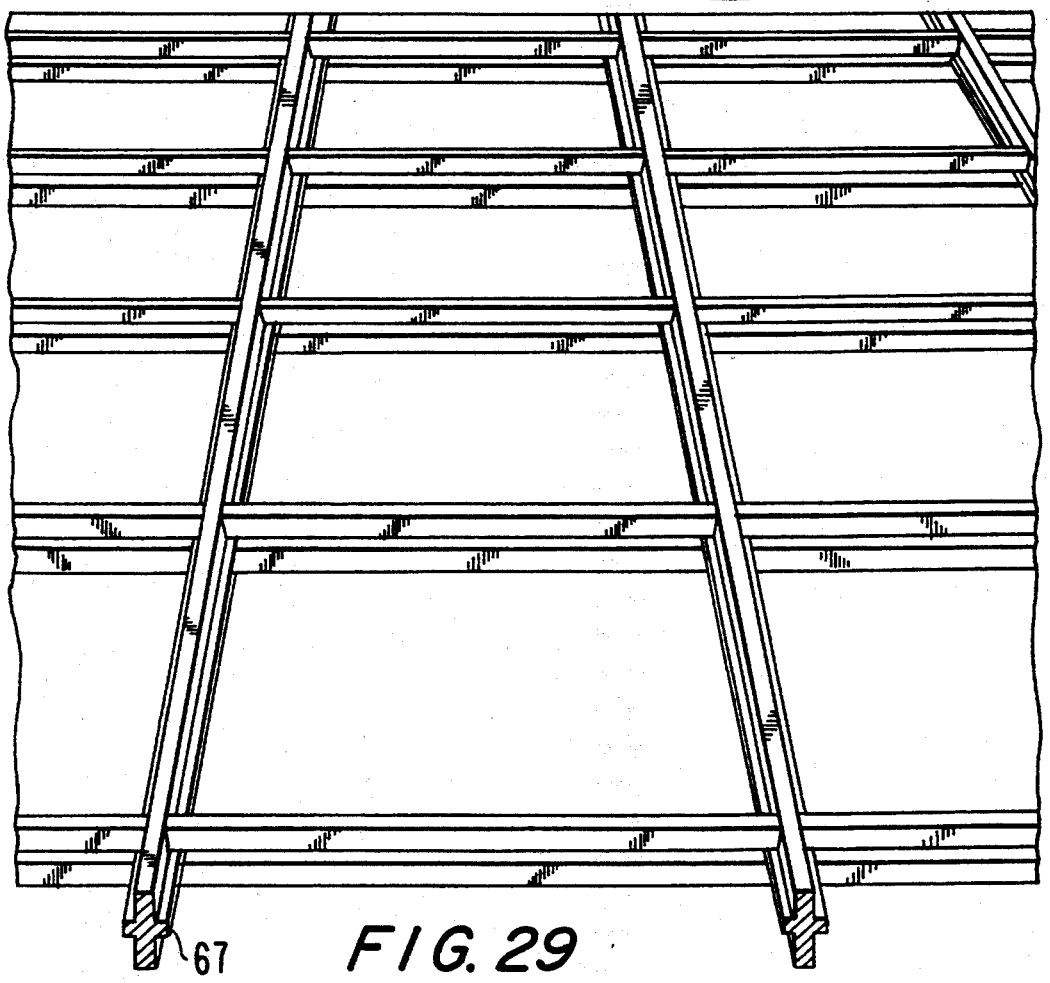
FIG. 29

TILING NETWORKS WITH GEOMETRICAL AND ORNAMENTAL PATTERNS

This is a continuation of U.S. application Ser. No. 07/939,456, filed Sep. 1, 1992, now abandoned.

FIELD OF THE INVENTION

The present invention relates to an apparatus and method for creating ornamental surfaces without using tile.

Background Of The Invention

A number of different devices and methods currently exist for making ornamental surfaces. One method for making ornamental floor surfaces comprises the use of a number of geometrically shaped tile units wherein each tile unit is individually manufactured and the floors are installed unit by unit. Disadvantages associated with this method are that the installation of the tile units is burdensome, the method can result in significant alignment errors between the tiles, the tiles are susceptible to damage during transportation, and the tiles are expensive to transport due to their size and weight.

Existing methods also sometimes utilize spacers which may be filled with colored materials between the individual tile units. Another method currently used to increase the ornamentation of tile floors is to engrave lines on the surface of the tiles. Disadvantages of this method are that the floor surface often becomes pitted due to the engraving and results in a surface which retains dirt and is very difficult to clean.

None of these methods are suitable for floors or other surfaces with a high degree of ornamentation, decoration, and multi-shaped tiles as the assembly and installation required by these methods is very complex. Furthermore, the use of pre-manufactured tiles often leads to a high incidence of breakage during manufacture, transportation, and installation thereby increasing costs. Additionally, floor installations using these methods are very time consuming, require specially trained individuals to install the tiles, and are therefore expensive to produce.

Another method currently used for making ornamental floors is to hand cut marble tiles piece by piece in order to create geometrical shapes on a floor surface. This method often results in a great deal of marble waste, requires specially trained technicians to install the marble, is extremely time consuming, limits the variety and complexity of ornamentation available, and is prohibitively expensive.

SUMMARY OF THE INVENTION

The disadvantages of the presently available methods and apparatus for making ornamental and decorative surfaces are overcome by the present invention. The present invention provides an improved method and apparatus for making an extremely broad variety of ornamental and decorative surfaces, namely ornamental and decorative floors, walls, domes, face-walls, and ceilings, both inside and outside ceilings, and roofs. Through the use of networks of units, the present invention provides the advantages of making such ornamental and decorative surfaces, without the use of tiles, that are easily manufactured and easily assembled. The networks of units are pre-manufactured according to the size, ornamentation, and decoration that is desired. The networks of units are comprised of a series of walls which form enclosed cavities.

The networks of units-may be manufactured in an unlimited number of geometric designs and configurations. After the networks of units are assembled, the cavities which are formed between the walls of the networks of units are filled with a material such as concrete. Different materials, or the same material having different colors or ornamental characteristics, may be poured into each individual cavity thereby adding to the decorative characteristics of the floor surface. The top surfaces of the walls of the networks of units may be manufactured and designed to have different colors and textures, also adding to the decorative features of the floor surface.

The networks of units may be assembled at the site where the ornamental surface is to be made. The present invention does not require a specialized technician to assemble a network of units and install an ornamental surface. Additionally, the present invention reduces the amount of time required to make an ornamental surface and significantly reduces the cost of making an ornamental and decorative surface. The present invention also allows surfaces such as floors to be made with ornamentation and decorations that cannot be accomplished with present methods and apparatuses.

Another advantage of the present invention is that the units of each network of units may be easily stacked, stored, and transported. Due to the relatively light weight of the units of the present invention, and the fact that the units may be stacked thereby taking up little space, the freight costs for shipping the units are relatively inexpensive.

BRIEF DESCRIPTION OF THE DRAWINGS

Further features of the invention, its nature and various advantages will be more apparent from the accompanying drawings in which like reference numerals refer to like elements and from the following detailed description of the invention.

FIG. 28 is a perspective view of an assembly unit for connecting two or more units.

FIG. 29 is a perspective view of a pattern of a network of units which may be installed on a roof or similar surface to prevent water penetration.

DETAILED DESCRIPTION OF THE INVENTION

Figure 1:
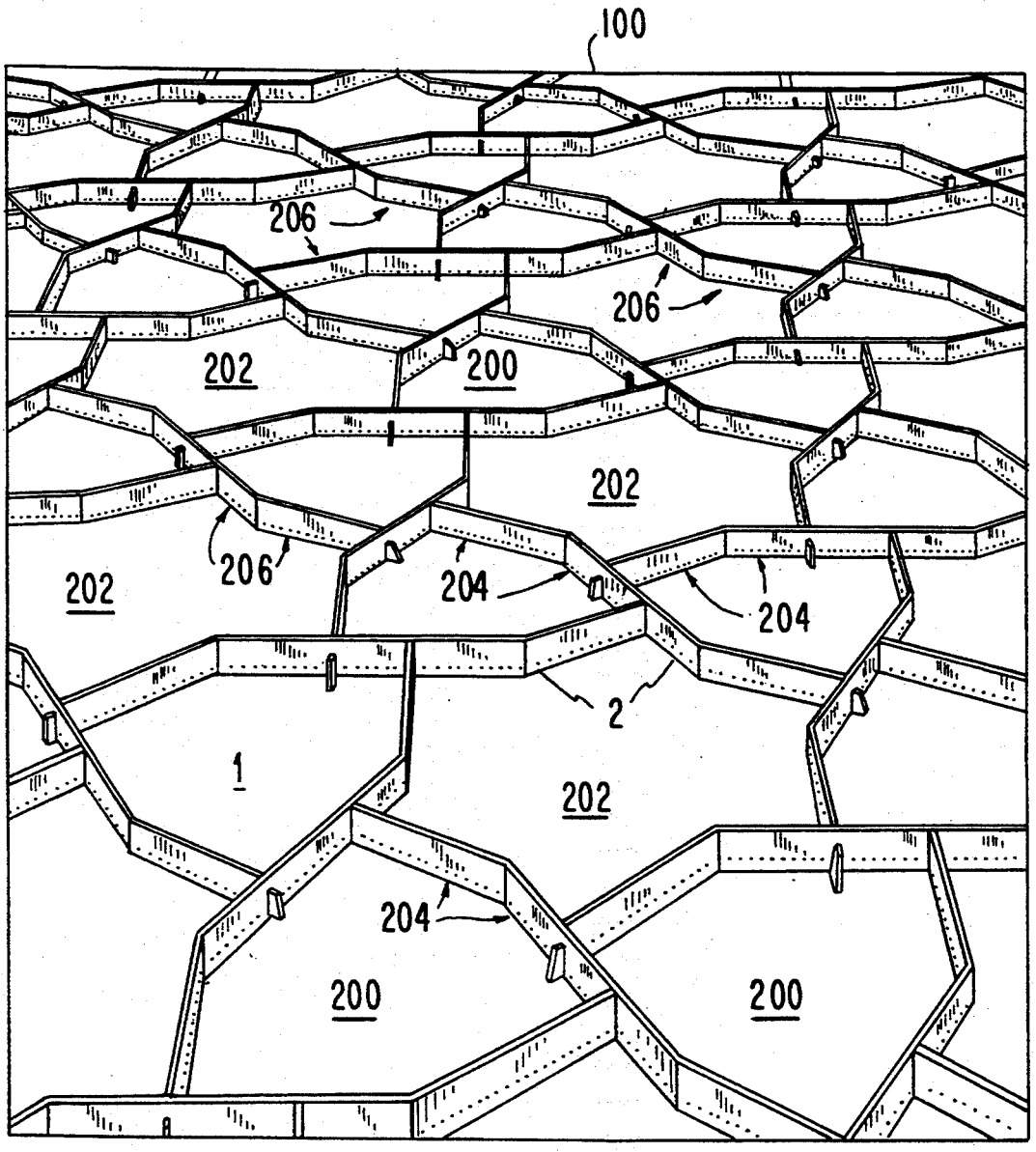
FIG. 1 is a perspective view of one pattern of an assembled network of units.
Figure 2:
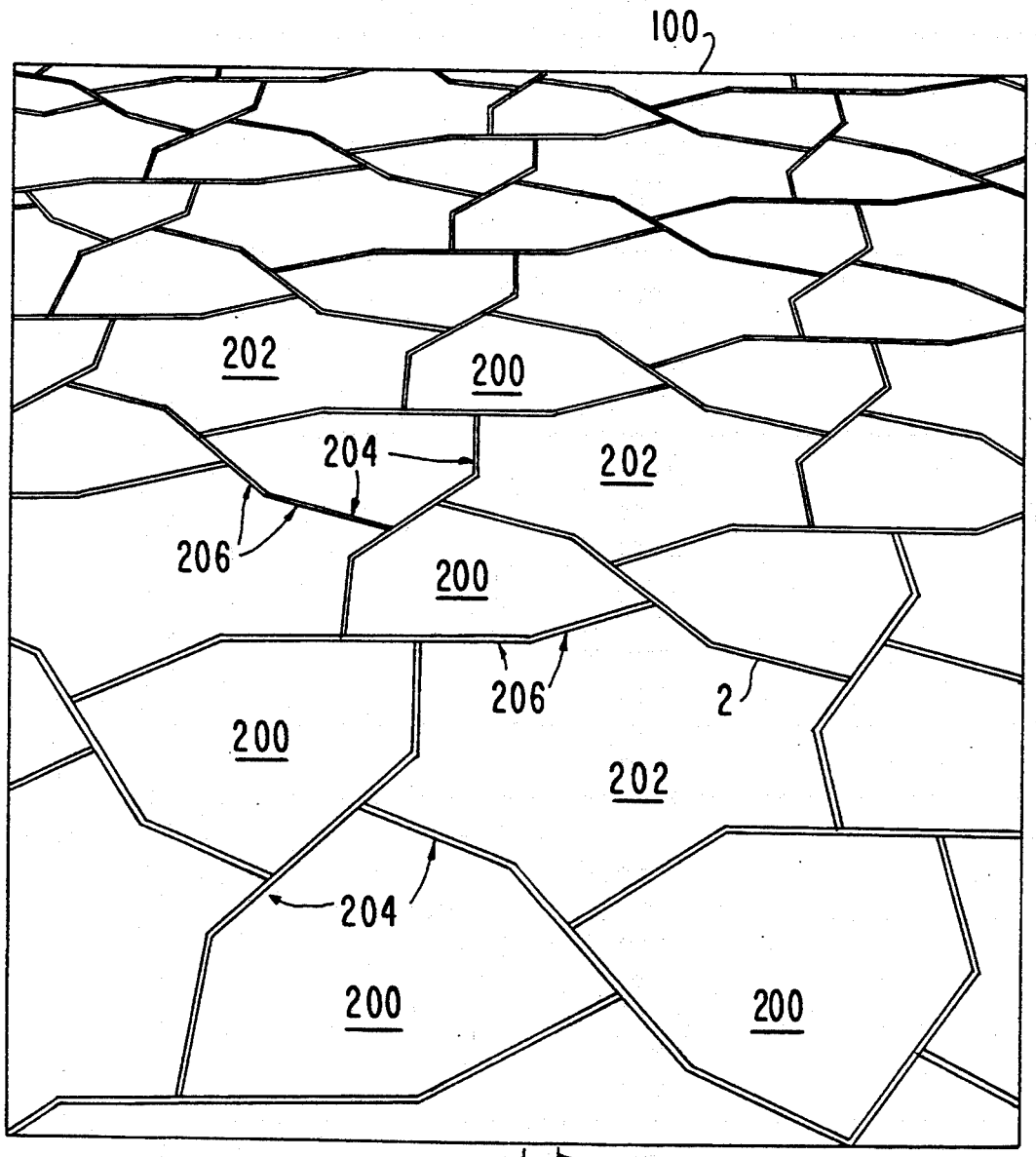
FIG. 2 is a perspective view of the network of units shown in FIG. 1 after the cavities between the walls of the network of units have been filled with a colored concrete.

Referring to the drawings in detail, the present invention may be illustrated. The drawings primarily illustrate the invention in the context of making ornamental floors, however it is to be understood that the present invention is not limited to making ornamental and decorative floors, but is contemplated for making ornamental and decorative walls, face-walls, domes, ceilings, both on the inside and outside, and roofs.

The networks of units are preferably made of a weatherproof material, such as acrylic, which is easy to cut, glue, and relatively easy to manufacture. Other suitable materials from which networks of units may be made include, but are not limited to, plastic compositions and certain metals such as aluminum, copper, and stainless steel.

The networks of units should be manufactured with a suitable thickness in the range of about 0.3 to 1.2 cm, for example, and height in the range of about 1.0 to 4.0 cm. The thickness and height of the walls of the networks of units should increase, sometimes proportionally, as the surface area of the cavities between the walls of the networks increases. Nevertheless, the sizing of the thickness and height of the networks of units of the present invention is not critical due to the fact that the material used to fill the cavities should adhere to the flooring surface as well as to the walls of the networks of units. Thus, a finished floor of the present invention will be adequately supported in all directions thereby making the floor highly resistant to fracture.

The top-surfaces of the units of the present invention may vary in size. Thus, an ornamental floor made with the present invention can have different sizes and colors of lines incorporated throughout the design. Additionally, the thickness of the walls of the units may vary in size from the top surface of the units to the bottom surface of the units. Variation in the thickness of the units of the present invention provides the advantage of reducing the amount of material required to manufacture the present invention, thereby reducing the cost to make the present invention. Furthermore, transportation costs may also be reduced if the weight of the units are reduced.

As with any network of units of the present invention, after the units are assembled and properly positioned, the cavities formed between and defined by the side walls of the units are filled with a material, such as concrete. The cavities may be filled with materials which have different colors, textures, and ornamental characteristics or the individual cavities may be filled with the same material, such as concrete.

In order to best utilize the present invention, the surface upon which the ornamental surface, such as a floor, is to be made should be properly prepared. If the floor will be exposed to rain or a significant amount of moisture, it is desirable to prepare the surface with a slight degree of incline to ensure that water may drain off of the surface of the completed floor. If the floor is constructed in a location where it will not be subject to rain or a significant amount of moisture, the surface should be prepared so that it is relatively level. Additionally, if a surface is not level, and a level floor surface is desired, the network of units assembled on the surface may be shimmed to ensure that the floor surface will be level.

The present invention may be installed one unit at a time, or several units may be assembled as a large unit and then connected to other assembled large units.

The network of units of the present invention may be affixed to the surface upon which the floor is to be made to ensure that the network remains in place while the material is poured into the cavities. One method which may be used to affix the network of units to the floor is by using a glue gun to glue down the bottom edge of the units. Typically, gluing the bottom edge of the units down approximately every meter will suffice. Gluing the networks of units down will also help prevent the units from floating up into the material which is used to fill the cavities.

Once the networks of units of the present invention are assembled, properly leveled, and affixed to the surface upon which the floor is to be built, the surface should be sprayed with water until it is saturated and wet. This is to ensure that the surface does not absorb a significant percentage of the water or moisture which is present in the material to be poured into the cavities.

When the materials that are to be used to fill the cavities, such as colored concrete, are prepared, they should be poured into the proper cavities until the materials rise to the top surface of the units or just above the top surface of the units, as desired. Various colors and ornamental characteristics of materials may be used to ornament a floor surface. If desired, a vibrator may be placed upon the network of units to help eliminate any air spaces in the materials which are poured into the cavities.

If concrete is used to fill the cavities, the concrete should be kept damp with water for approximately three days. After the material used to fill the cavities is fully dried, the floor surface may be burnished and polished by using various types of machines in order to completely reveal the ornamentation created by utilization of the present invention.

The present invention may also be used to make special roofs, as shown in FIG. 29, or water closet networks. The networks of units having protruding lines (67) on both sides of the units can provide a waterproof surface. The protruding lines function to prevent water leakage. If a waterproof surface is desired, the material used to fill the cavities should also be waterproof, such as waterproof concrete.

As previously stated, the ornamental networks of units of the present invention may also be used to make walls, face-walls, ceilings, dome ceilings, domes, and roofs. The cavities of the networks of units of the present invention, if used for walls or ceilings, may be filled with a variety of materials, including colored mortars and gypsum.

As shown in FIGS. 1–10, the present invention is an apparatus for constructing an ornamental surface which comprises a repetitive ornamental pattern. The repetitive ornamental pattern comprises a first sub-pattern 200 and a second sub-pattern 202, the first sub-pattern having a number of walls 204, the second sub-pattern having twice the number of walls 206 of the first pattern. Each of the walls 204 and 206 o each sub-pattern 200 and 202 respectively is substantially identical to the other walls of that sub-pattern.

Figure 3:
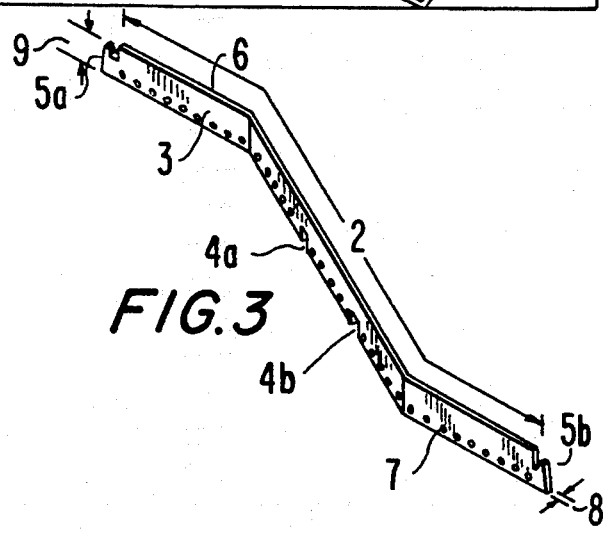
FIG. 3 is a perspective view of one unit of the network of units shown in FIG. 1.

The apparatus comprises a network of substantially identical non-connected units (elements (2), (11), (15), (20), and (21) of FIGS. 1, 4, 6, 8, and 9 respectively). Each of the units has a top surface (6), a bottom surface, and two sides (3). Each of the units is also angled (see FIGS. 1–3, 6, 8 and 9) or arced (see FIGS. 4–5 and 9) at at least two locations lengthwise along the unit whereby a second lengthwise half of the unit is a mirror image of a first half of the unit. This is shown in FIGS. 3 and 5. Each unit comprises means arranged along the length of the unit for engaging that unit to the corresponding engaging means on at least one other unit (4*a*), (4*b*), (13*a*) and (13*b*). The engaging means is positioned on each unit whereby each unit forms at least the wall of a first sub-pattern and the wall of a second sub-pattern when the network of units is assembled. The network of units cooperates to form the repetitive ornamental pattern with each wall of each sub-pattern comprising an angle or arc.

In a method for constructing an ornamental surface of the type discussed above, the network of substantially identical non-connected units is assembled on a floor surface. The network of units is then levelled and affixed to the floor surface. Finally, a filling material is poured into the cavities formed by the network of units to the top of the units.

Various embodiments of the networks of units of the present invention are illustrated in FIGS. 1 to 29. The patterns of networks of units shown in the drawings of the present invention increase in complexity as the drawing numbers increase.

As shown in FIG. 1, after individual units (2) of the present invention are manufactured, the units are assembled into a network of units (100) on a relatively level surface, such as a concrete surface. The cavities (1) formed by the network of units (100) are filled by pouring a material, such as concrete, which may be colored or contain certain ornamental or decorative characteristics, into the cavities. The resulting product of the present invention is a level ornamental floor (100) shown in FIG. 2. Additional details pertaining to the preparation of the flooring surface are described above.

In FIG. 3, the units utilized to make the ornamental floor (100) have side wall notches (4*a* and 4*b*) and end notches (5*a* and 5*b*). The end notches and side wall notches are used to join and connect the individual units to make a network of units. The end notch on one end of a unit may be joined and connected to a side wall notch of a second unit. Thus, when all of the units of the present invention are assembled they form a network of units for an ornamental floor. Because the end notches and side wall notches are lower than the top surface (6) of the unit, the connections formed between the end notches and the side wall notches are hidden from view when the floor is complete. The thickness of the unit (8) is about 0.3 to 1.2 cm, and the height (9) of the unit is about 1.0 to 4.0 cm.

The networks of units of the present invention may include design characteristics, features, and reinforcements to: (1) increase the adherence characteristics of the material poured into the cavities to the units; (2) increase the stability characteristics of the networks; and (3) ensure that the networks of units do not float or deform from the pressure of the material used to fill the cavities formed between the units. For example, the unit of the present invention may have a base perpendicular to the sides (see 37, 45, 49, and 53 shown in FIGS. 19, 20, 21, and 22, respectively). A unit with a base would not affect the ornamentation of the floor because the base of the unit would be hidden beneath the material which is poured into the cavities. As shown in FIG. 3, a plurality of openings (7) may be inserted through the sides in the lower half of the side wall (3) to join the unit with the concrete.

Figure 4:
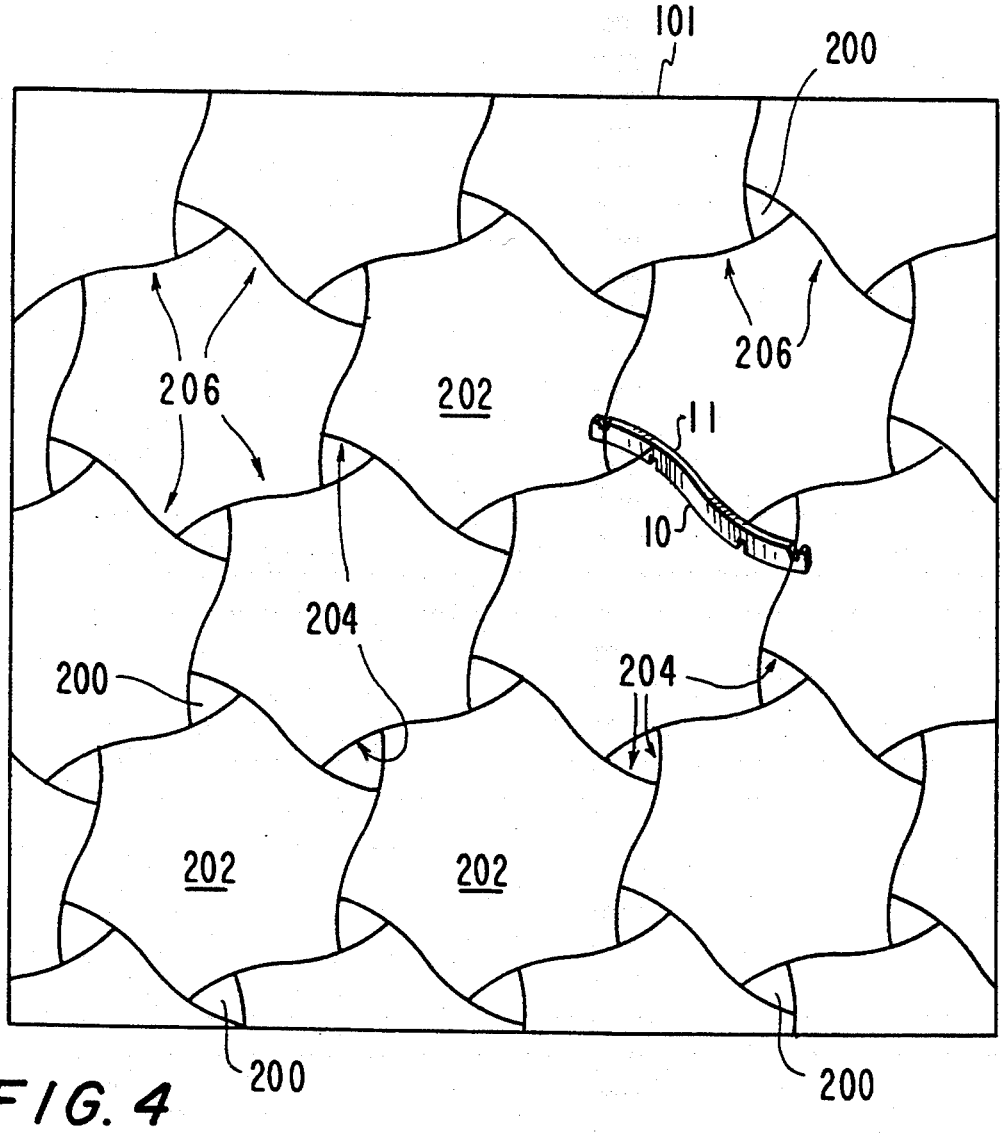
FIG. 4 is a top view of one pattern of an assembled network of units also showing a perspective view of one unit of the network of units of the pattern.
Figure 5:
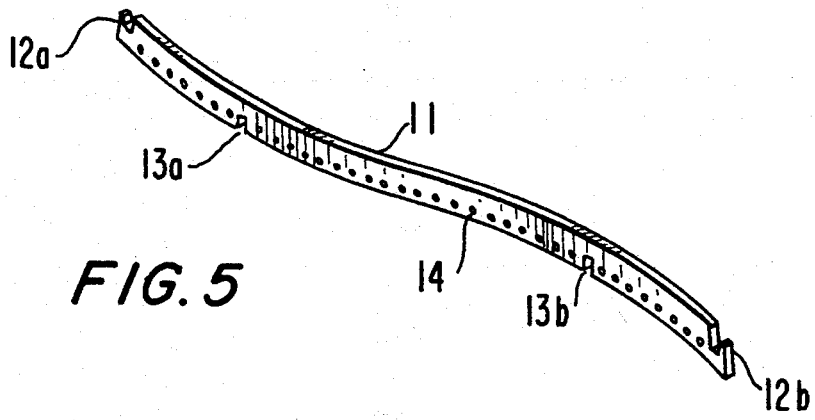
FIG. 5 is a perspective view of one unit of the network of units shown in FIG. 4.

FIG. 4, specifically highlighted curved line (10), illustrates how the top surface (11) of a unit of the present invention may be used to ornament a floor between the filled cavities in a network of units for an ornamental floor (101). A full perspective view of the unit utilized in FIG. 4 is shown in FIG. 5. The units forming the network of units shown in FIG. 4 of the present invention are assembled in the same manner as described above for FIG. 1, using the end notches (12*a* and 12*b*) and side wall notches (13*a* and 13*b*) to connect the units. A plurality of openings (14) have been inserted through the sides in the lower half of the side wall to facilitate joining the unit (10) with the concrete.

Figure 6:
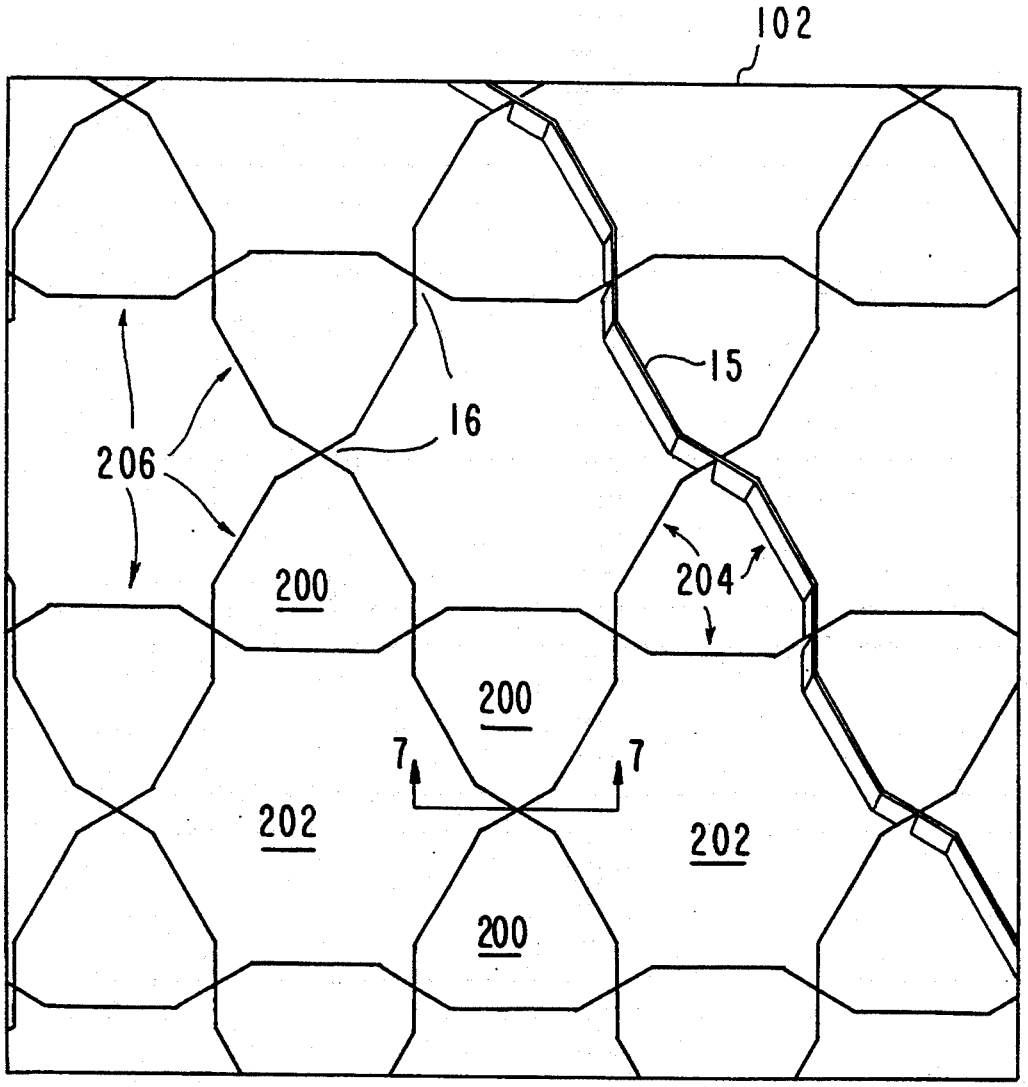
FIG. 6 is a top view of one pattern of an assembled network of units also showing a perspective view of one unit of the network of units of the pattern.

FIG. 6, specifically highlighted line (15), illustrates the relative shape and size of a unit of the present invention utilized to make the ornamental floor design (102) shown in FIG. 6. The length of the units for this design may vary in size but are typically approximately 2 meters long. The units of the network of units (102) shown in FIG. 6 are assembled end-to-end to form a continuous ornamental line. The units are connected in this manner by fastening the units together with an adhesive, such as glue, or by using an assembly unit (62) as shown in FIG. 28. Additionally, the units of the present invention exhibited in FIG. 6 have corresponding intersecting slots (16) which are shown in detail in FIG. 7, a perspective view of Section (A—A) of FIG. 6. The corresponding intersecting slots (16) of the present invention are used to permit individual units to intersect with one another as shown in FIG. 6. At the point of intersection, one corresponding unit has a slot which runs from the midsection of the unit to the bottom of the unit and the second corresponding unit has a slot which runs from the top of the second unit to the midsection of the second unit. Thus, the two corresponding intersecting slots permit the two units to mate and intersect with one another.

Figure 7:
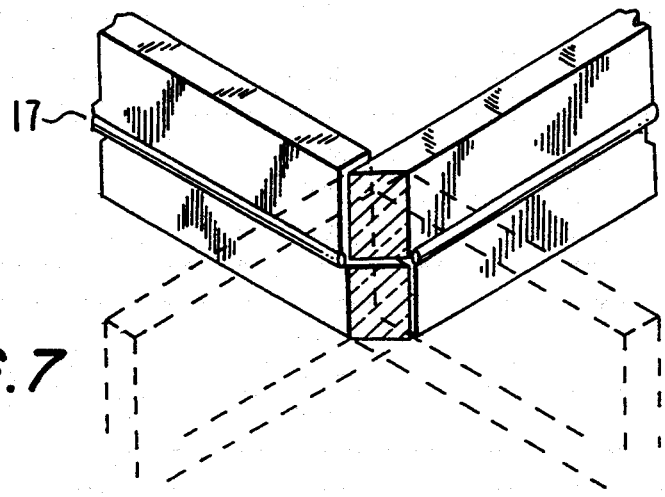
FIG. 7 is a perspective view of section A—A of FIG. 6.

The units of the present invention sometimes have linear protrusions extending out from the mid-sections of the sides of the units from end to end of the unit. An example of such a linear protrusion (17) is illustrated in FIG. 7. Such linear protrusions of the present invention provide several important benefits. They increase the bonding and adhesion between the units and the material which is poured into the cavities. The linear protrusions also increase the surface area to which the material poured into the cavities can adhere. Additionally, the linear protrusions assist in preventing the units from floating in the material and structurally strengthen the units to inhibit their deformation.

Figure 8:
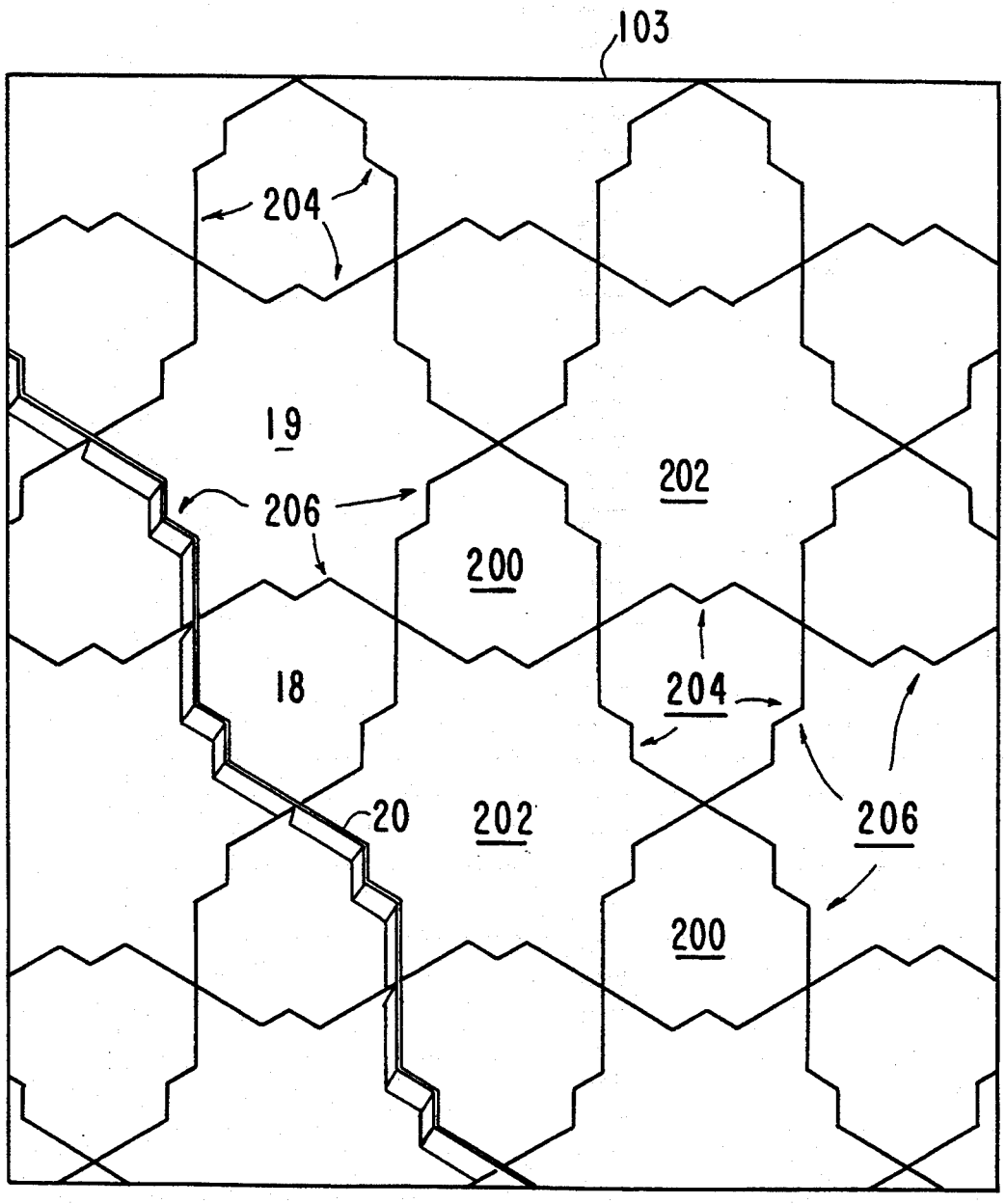
FIG. 8 is a top view of one pattern of an assembled network of units also showing a perspective view of one unit of the network of units of the pattern.

The network of units (103) of the present invention exhibited in the ornamental floor design in FIG. 8 form two types of cavity shapes (18 and 19). The two cavity shapes are bordered by the same type and pattern of unit (20) having protrusions in the pattern—cavity (18) is bordered by three units (20) and cavity (19) is bordered by six units (20). While current methods and devices available for making ornamental floors cannot produce the type of ornamentation shown in FIG. 8, the present invention permits the creation of such a floor design. The units forming the network of units shown in FIG. 8 of the present invention are assembled using corresponding intersecting slots in the same manner as described for FIG. 6.

Figure 9:
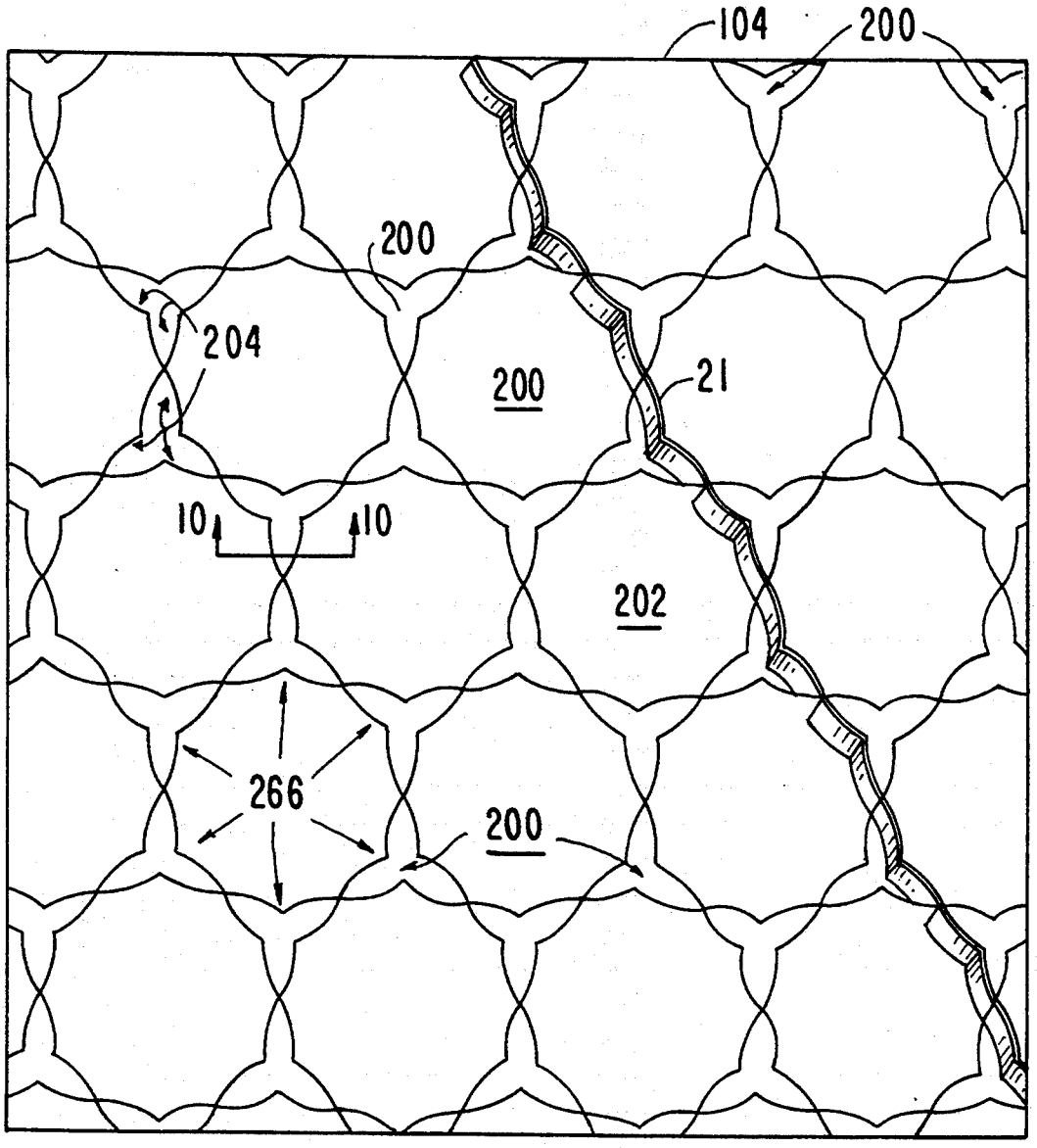
FIG. 9 is a top view of one pattern of an assembled network of units also showing a perspective view of one unit of the network of units of the pattern.
Figure 10:
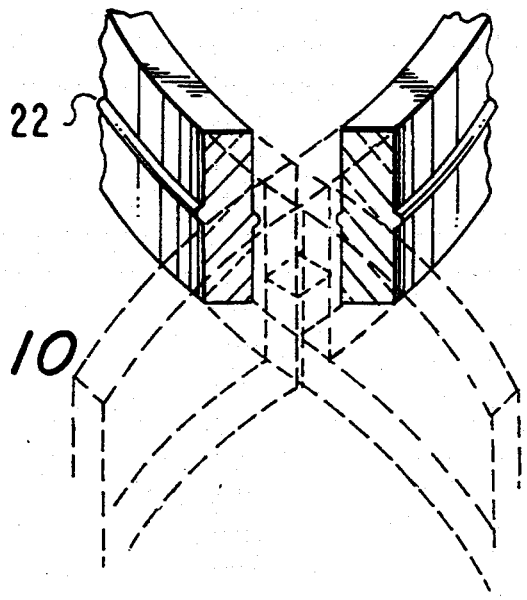
FIG. 10 is a perspective view of section B—B of FIG. 9.

FIG. 9 illustrates another ornamental floor pattern (104) which may be made with the present invention. A perspective view of the type of units of the network of units shown in FIG. 9 is exhibited as highlighted line (21). Section B—B, shown in detail in FIG. 10, provides a detailed view of the corresponding intersecting slots of the units and how the units intersect and mate with one another. The units shown in this pattern may also incorporate linear protrusions (22) on both sides of the units, for the same purposes as described in relation to FIG. 7, above.

Figure 11:
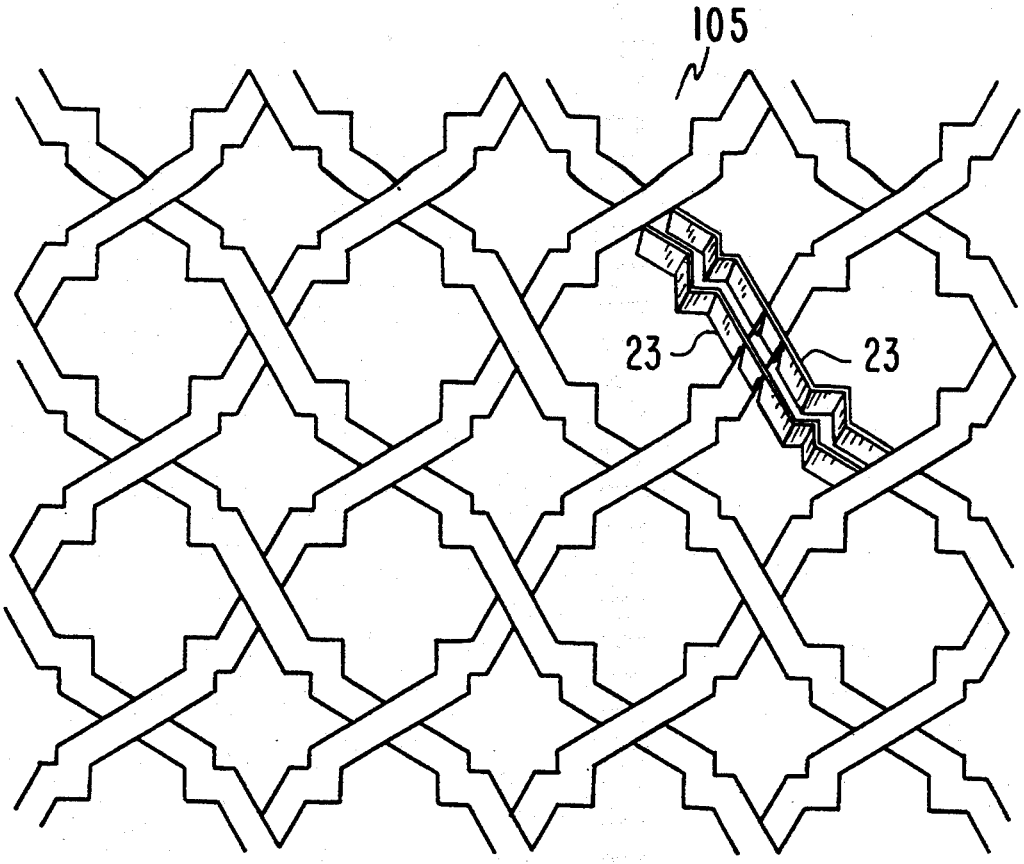
FIG. 11 is a top view of one pattern of an assembled network of units also showing a perspective view of one unit of the network of units of the pattern.
Figure 12:
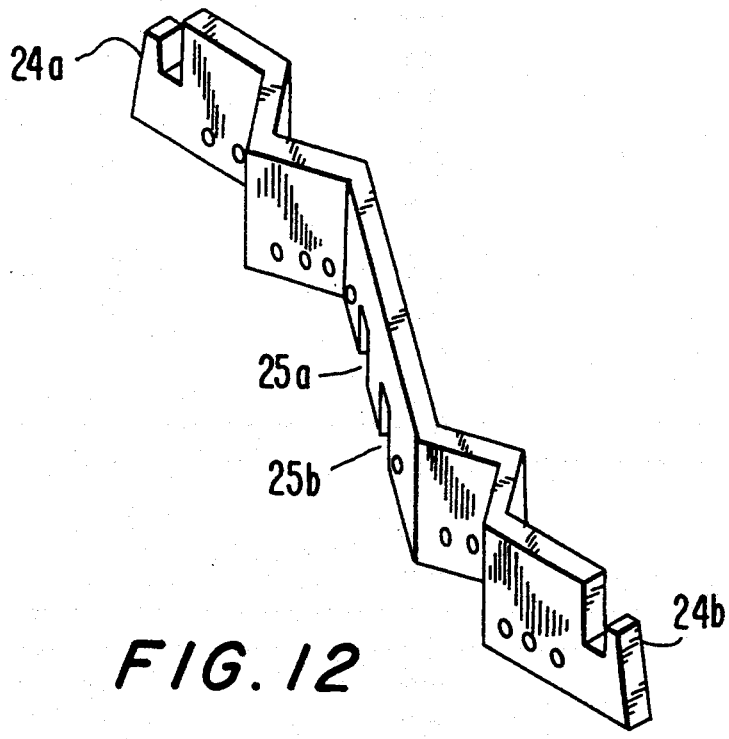
FIG. 12 is a perspective view of one unit of the network of units shown in FIG. 11.

The ornamental floor pattern (105) shown in FIG. 11 is made by utilizing a network of units of the present invention. FIG. 12 shows a perspective view of the unit (23) used to make the network of units shown in FIG. 11. The floor pattern shown in FIG. 11 requires that two of the same unit (23) be assembled parallel to each other throughout the pattern. The units (23) have end notches (24*a* and 24*b*) and side wall notches (25*a* and 25*b*) for assembly in the manner described above for FIGS. 1 to 3.

Although the drawings do not show such a combination, the units of the present invention may connect units with both end notch—side wall notch connections and corresponding intersection slots.

Figure 13:
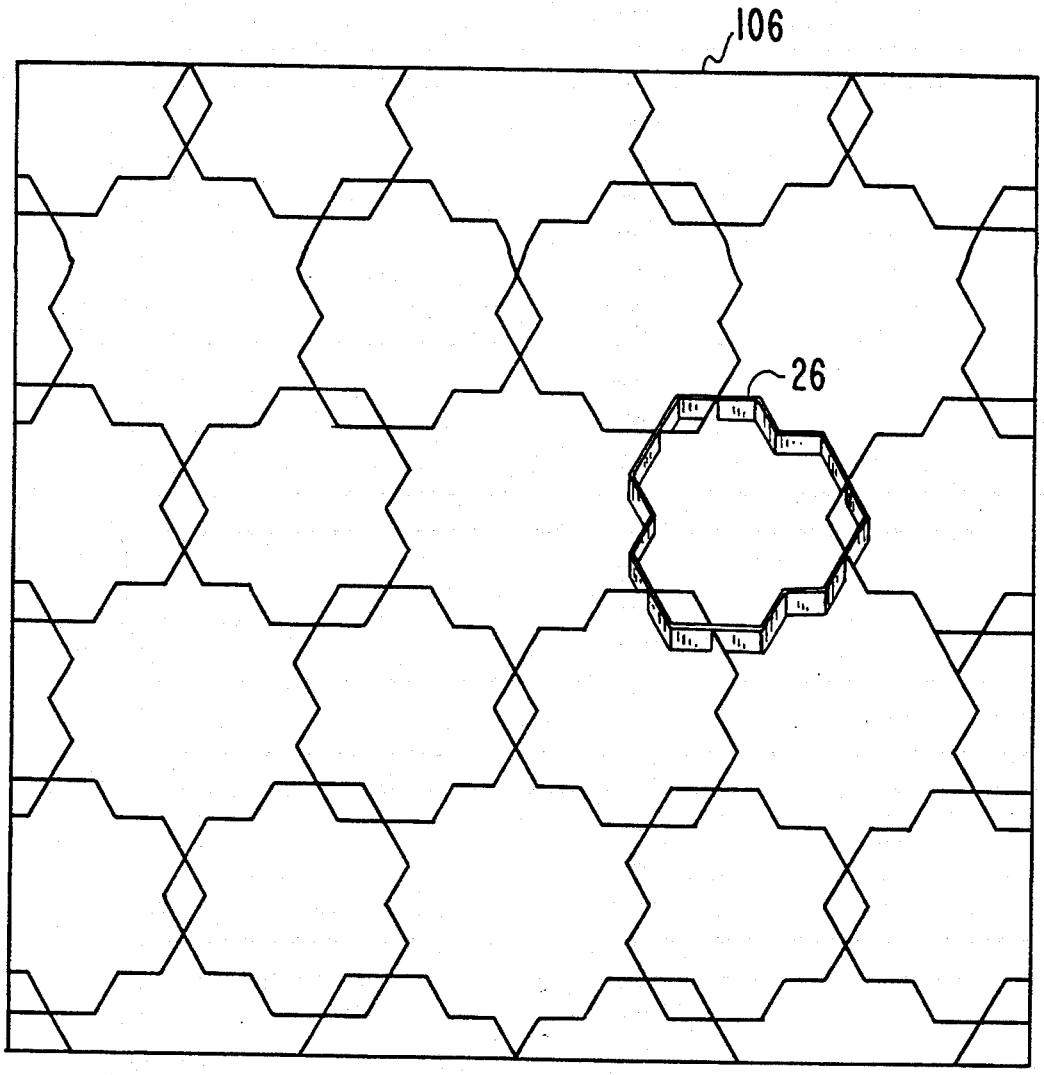
FIG. 13 is a top view of one pattern of an assembled network of units also showing a perspective view of one unit of the network of units of the pattern.
Figure 14:
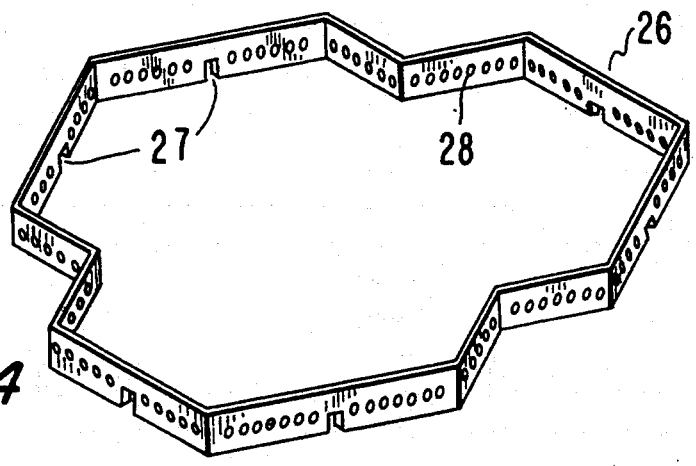
FIG. 14 is a perspective view of one unit of the network of units shown in FIG. 13.

FIG. 13 illustrates a network of units (106) of the present invention using units which are fully enclosed ornamental forms (26). FIG. 14 illustrates a perspective view of the fully enclosed ornamental form (26) used to make the floor pattern (106) shown in FIG. 13. The unit (26) shown in FIG. 14 may be assembled and connected with other such units by utilizing corresponding intersection slots (27) or by using an assembly unit (62) as shown in FIG. 28. A plurality of openings (28) inserted through the sides in the center of the side wall of the unit functions to join with concrete poured into the cavity. The openings (28) may be replaced with linear protrusions or juts on both sides of the unit (26). Additionally, the fully enclosed ornamental units of the present invention may be manufactured in more than one piece to be assembled at the site so that they may be transported, packaged, and stored more easily.

The unit (26) shown in FIG. 14 may also be utilized to make the floor pattern (103) shown in FIG. 8. This demonstrates another advantage of the present invention—one type and pattern of unit may be used to make more than one type of ornamental floor design pattern.

Figure 15:
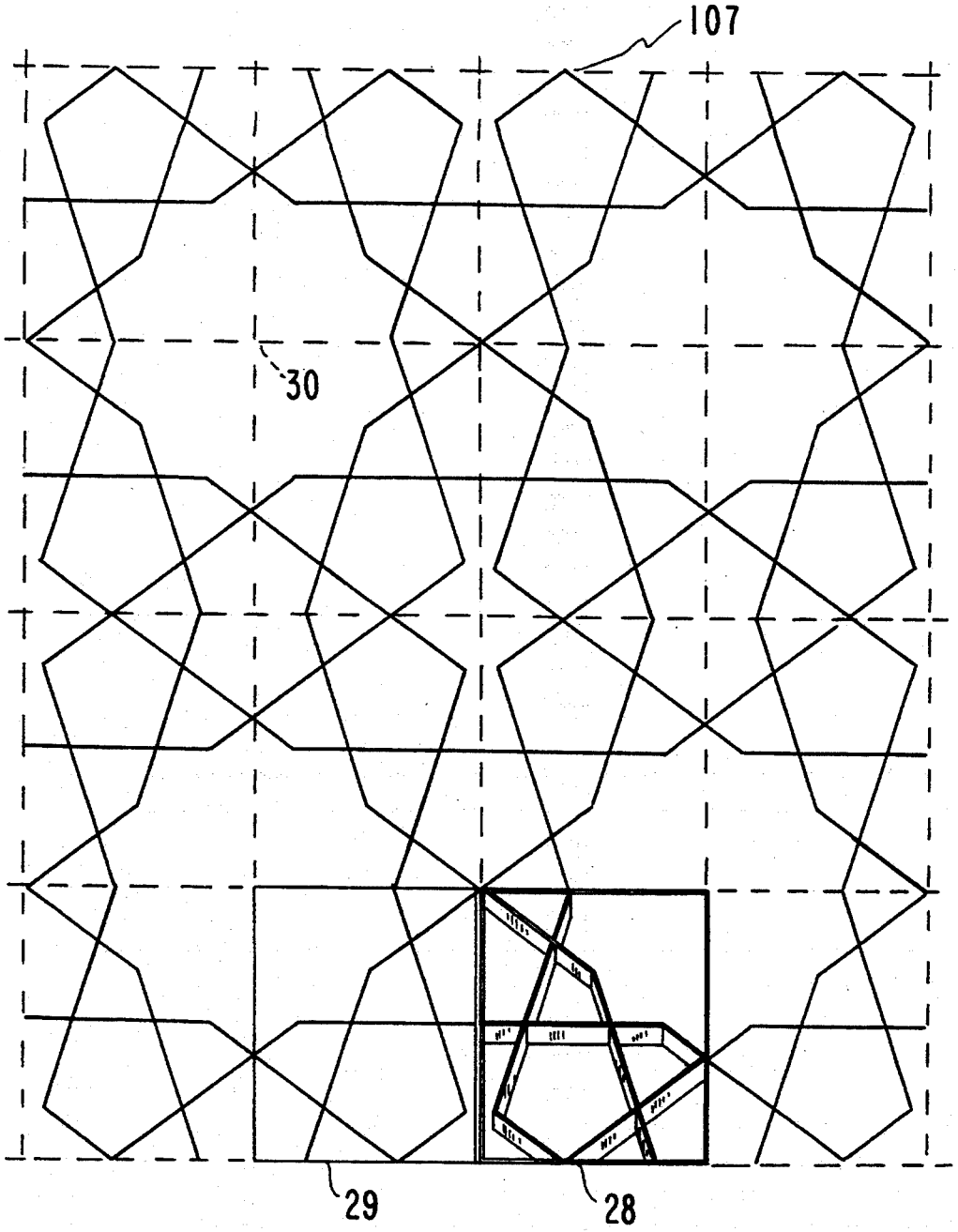
FIG. 15 is a top view of one pattern of an assembled network of units also showing a perspective view of one unit of the network of units of the pattern.

The network of units of the present invention shown in FIG. 15 illustrates a floor pattern (107) comprised of mirror images of the unit (28). The size of the unit is about 80×80 cm and is about 3 cm high. The unit (28) may be inverted to make the mirror image unit (29). The thickness of the lines in the unit is about 0.8 cm. The main lines may be thicker than the secondary lines in the unit, if desired. The units may be assembled by gluing the units to one another, or by using an assembly unit (62) as shown in FIG. 28. The dotted lines (30) delineate the area limits of each unit in the network of units. This floor pattern (107) demonstrates that units of the present invention may be manufactured so that either the top or bottom surface of the unit may be used as part of the floor surface. Thus, floor patterns may be made with mirrored images of the units.

Figure 16:
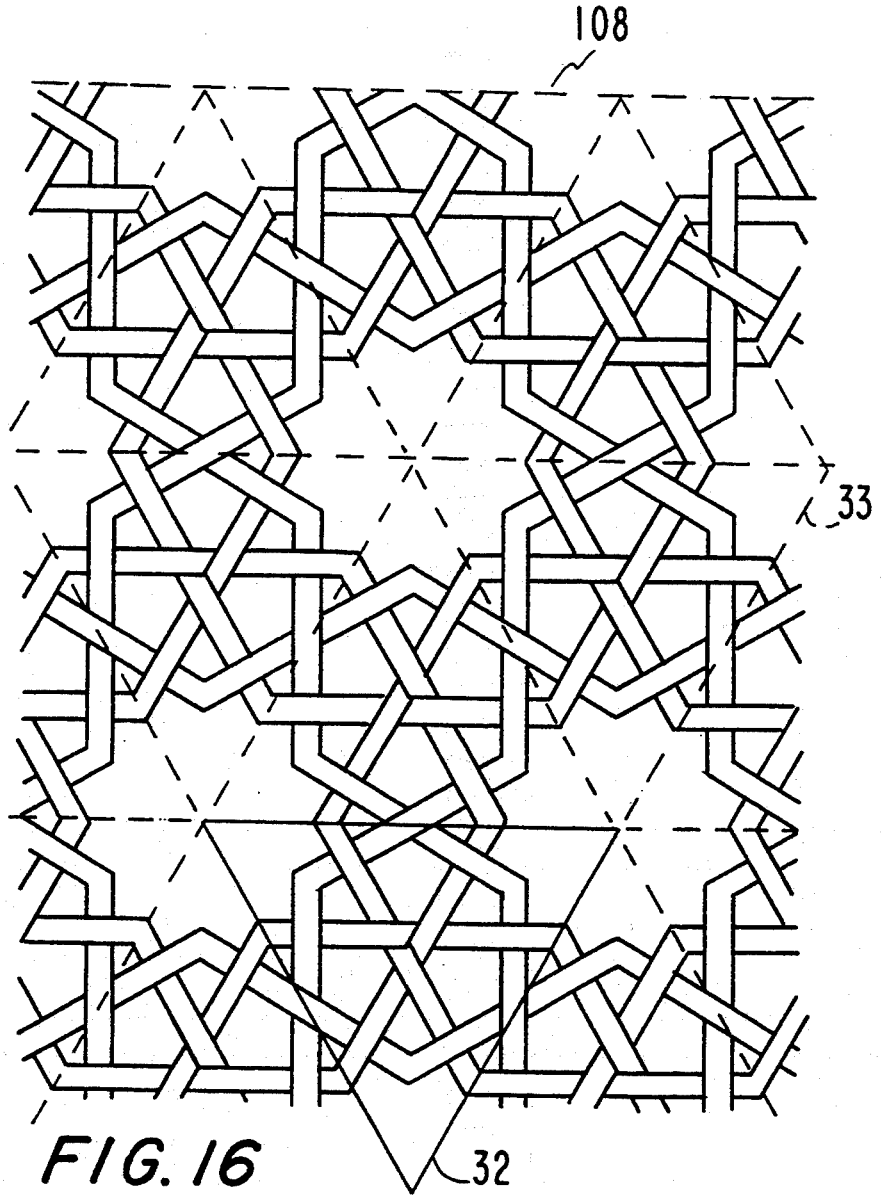
FIG. 16 is a top view of one pattern of an assembled network of units also showing the relative size of one unit of the network of units of the pattern.
Figure 17:
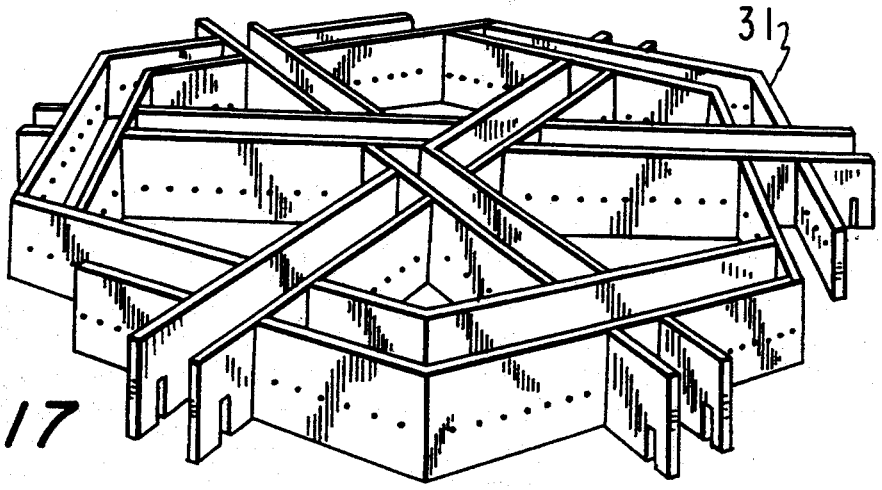
FIG. 17 is a perspective view of one unit of the network of units shown in FIG. 16.

In FIG. 16, the network of units (108) of the present invention uses the unit (31) shown in FIG. 17. The triangles, shown in FIG. 16 as solid lines (32) and imaginary dotted lines (33), represent individual units used to form the network of units. The units are utilized to make the ornamental floor surface (108) shown in FIG. 16 by placing the units adjacent to each other and either gluing the units together or fastening them to one another with an assembly unit (62) shown in FIG. 28.

Figure 18:
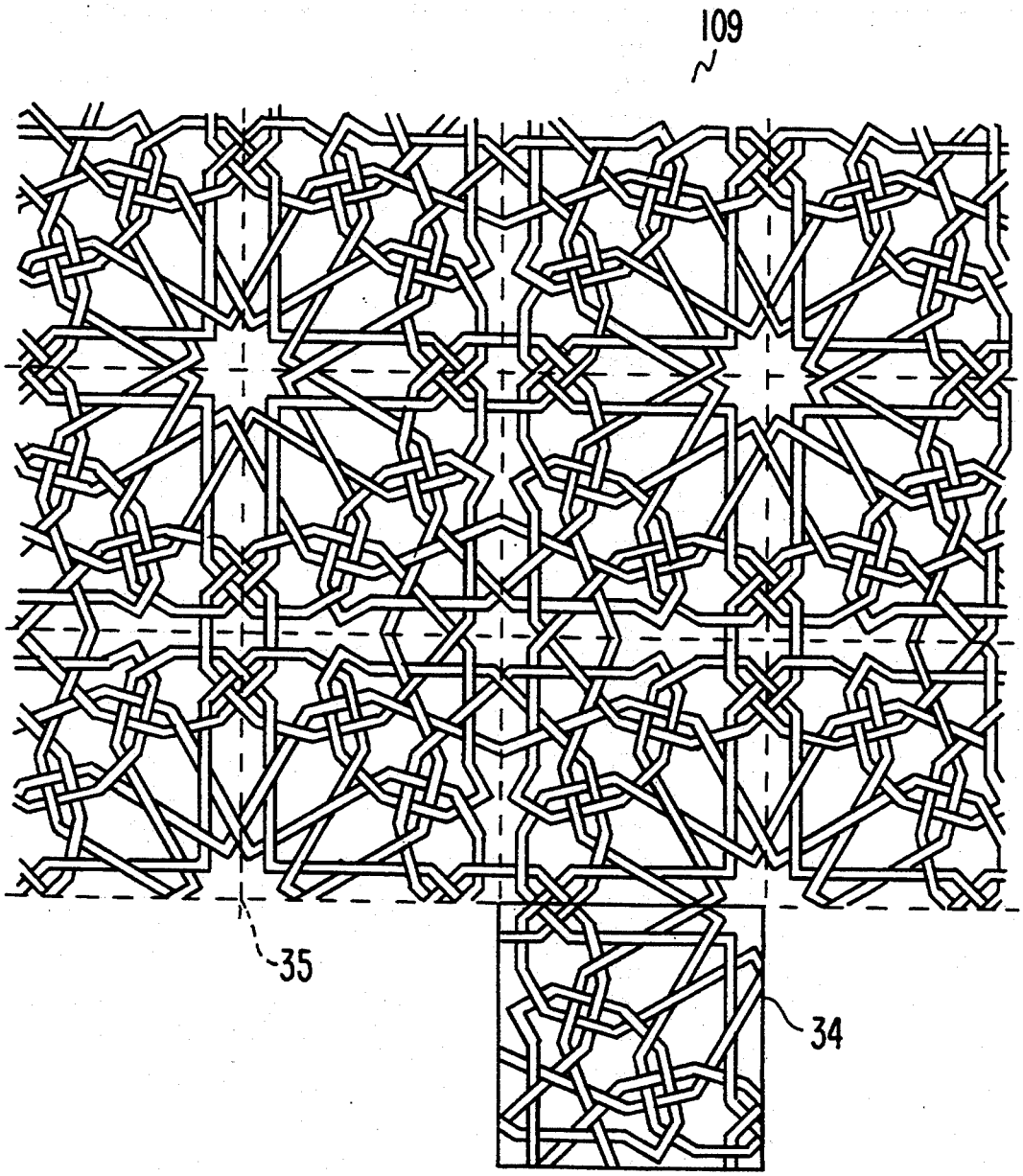
FIG. 18 is a top view of one pattern of an assembled network of units also showing the relative size of one unit of the network of units of the pattern.

FIG. 18 illustrates another ornamental floor (109) which can be made with the present invention. The basic unit (34) of the network of units is shown in FIG. 18 as an imaginary square delineated by dotted lines (35) or by solid lines. The floor pattern is created with mirror images of the unit (34), using the same method of inverting units to make mirror images described above in connection with FIG. 15. Current methods for making ornamental floors cannot make a floor design pattern as shown in FIG. 18 as easily, as inexpensively, and with the precision that can be accomplished with the present invention.

The present invention may make floor surfaces with ornamental designs which have lines incorporated within a design pattern in which the lines have relatively large distances between them. A common problem which typically occurs with this type of design pattern is that the network of units does not have sufficient stability to withstand the pressure created by the material which is used to fill the cavities formed between the units which make the lines in the design. As a result, the units tend to deform, and the material used to fill the cavities may crack. The present invention overcomes this problem by utilizing the special units shown in FIGS. 19 to 22.

Figure 19:
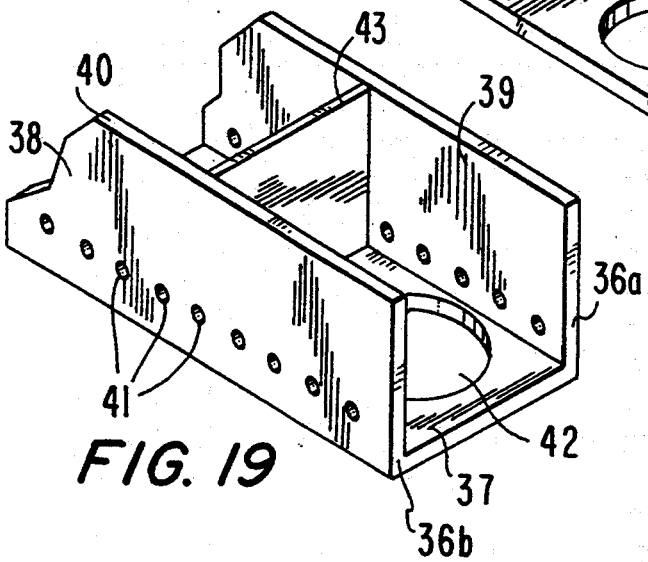
FIG. 19 is a perspective view of a portion of a unit for making special ornamental networks of units.

FIG. 19 depicts a special "U" shaped unit of the present invention. The "U" shaped unit is composed of a first leg (36*a*) and a second leg (36*b*) and a base (37), each leg having an exterior surface (38) and an interior surface (39) and a top surface (40). The "U" shaped unit may be designed with a plurality of openings (42) through its base so that the material used to fill the cavity between the two legs will adhere to the surface of the prepared floor surface. Furthermore, the openings (42) prevent the units from floating in the material used to fill the cavities. The "U" shaped unit is preferably manufactured in 2.0 m lengths and may be cut at the site to make special ornamental forms.

The "U" shaped unit of the present invention may also have two additional design features. The unit may be manufactured with small partitions (43) in order to reinforce the material used to fill the cavities, thereby decreasing the likelihood that the material will crack. The partitions are placed at regular intervals in the "U" shaped unit, for example one every 60 cm. Additionally, the "U" shaped unit may incorporate a plurality of openings through its legs (41). These openings serve several purposes: (1) they increase the surface area upon which the material poured into the cavities and adjacent to the unit may adhere to; (2) they increase the unit's resistance to deformation from the pressure of the material poured into the cavities by equalizing the pressure between the cavities; and, (3) they prevent the unit from floating in the material poured into the cavities. This feature may be utilized in any unit of the present invention. It should be noted that the plurality of openings may used in combination with, or in: lieu of, linear protrusions on both sides of the units.

Figure 20:
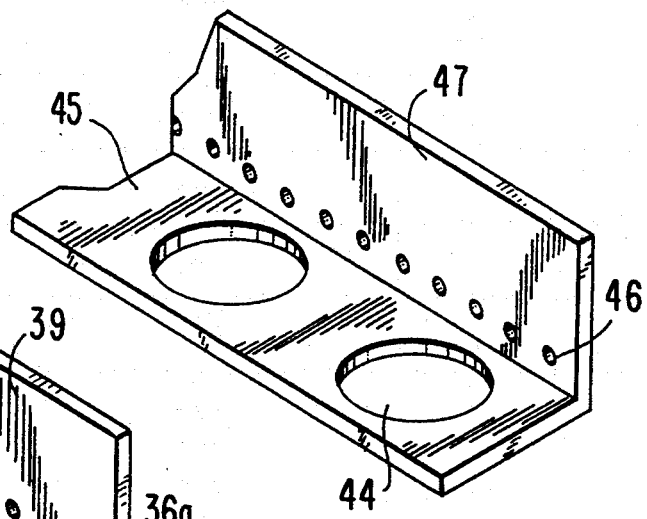
FIG. 20 is a perspective view of a portion of a unit for making special ornamental networks of units.
Figure 21:
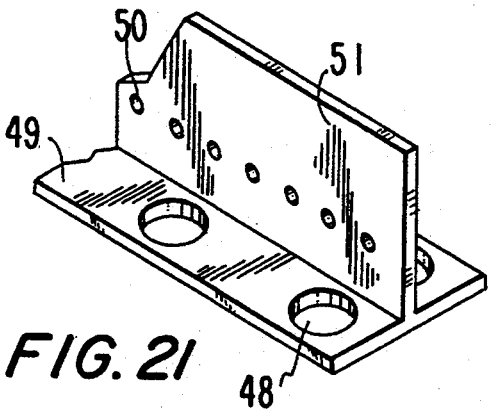
FIG. 21 is a perspective view of a portion of a unit for making special ornamental networks of units.
Figure 22:
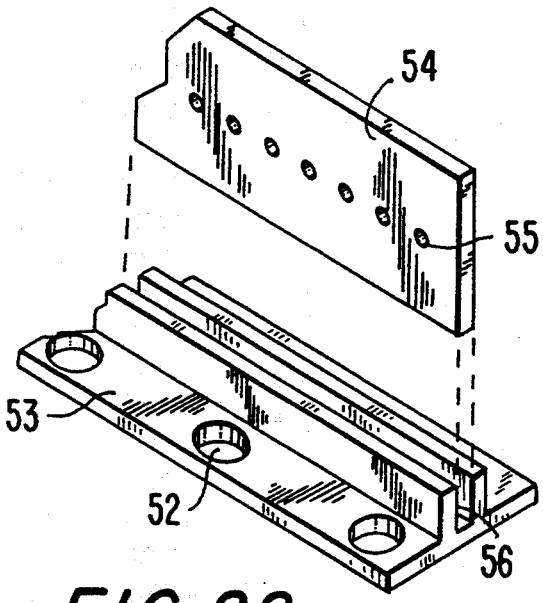
FIG. 22 is a perspective view of a portion of a unit for making special ornamental networks of units.

FIGS. 20, 21, and 22 show embodiments of the present invention which may also be used where networks of units require different stability and adhesion characteristics. The openings through the bases (44, 48, and 52, respectively), and the plurality of openings through the legs (46, 50, and 55, respectively), provide the units represented in FIGS. 20, 21, and 22 with the same benefits and characteristic as "U" shaped units. The unit in FIG. 20 has an "L" shape comprising a base (45) and a leg (47) perpendicularly connected to the base. The unit in FIG. 21 has an inverted "T" shape comprised of a base (49) and a leg (51) perpendicularly connected to the base (49). In FIG. 22, the unit also has an inverted "T" shape which can be separated into two parts, a base (53) and a leg (54). The unit has a longitudinal center slot (56), to which the leg (54) is removably and perpendicularly connected. This feature permits a design to have intermittent portions of units inserted periodically to enhance the ornamental design or pattern of a floor surface.

Each of the above described special units of the present invention depicted in FIGS. 19, 20, 21 and 22 have a beneficial feature of allowing floor surface designs to be made which incorporate independent lines that are not visually or mechanically connected to a network of units as part of the ornamental pattern of a floor. For example, in FIG. 26, the "U" shaped unit of FIG. 19 is used in connection with the pattern (113) of FIG. 26 to extend straight lines (61*a*) and (61*b*) along the border of the floors. Due to the stability of each of the respective special units, independent lines of varying widths can be made. If a wide colored line, wider than the course width of FIG. 19, is desired, then two parallel lines can be made using any of the special units of FIGS. 20 to 22, with the distance between the lines made by the special units equal to the desired width. Colored material such as concrete is then poured into the course made by the lines. If the lines are long, then thin partitions may be inserted at intervals between the lines to avoid cracking of the material.

Figure 23:
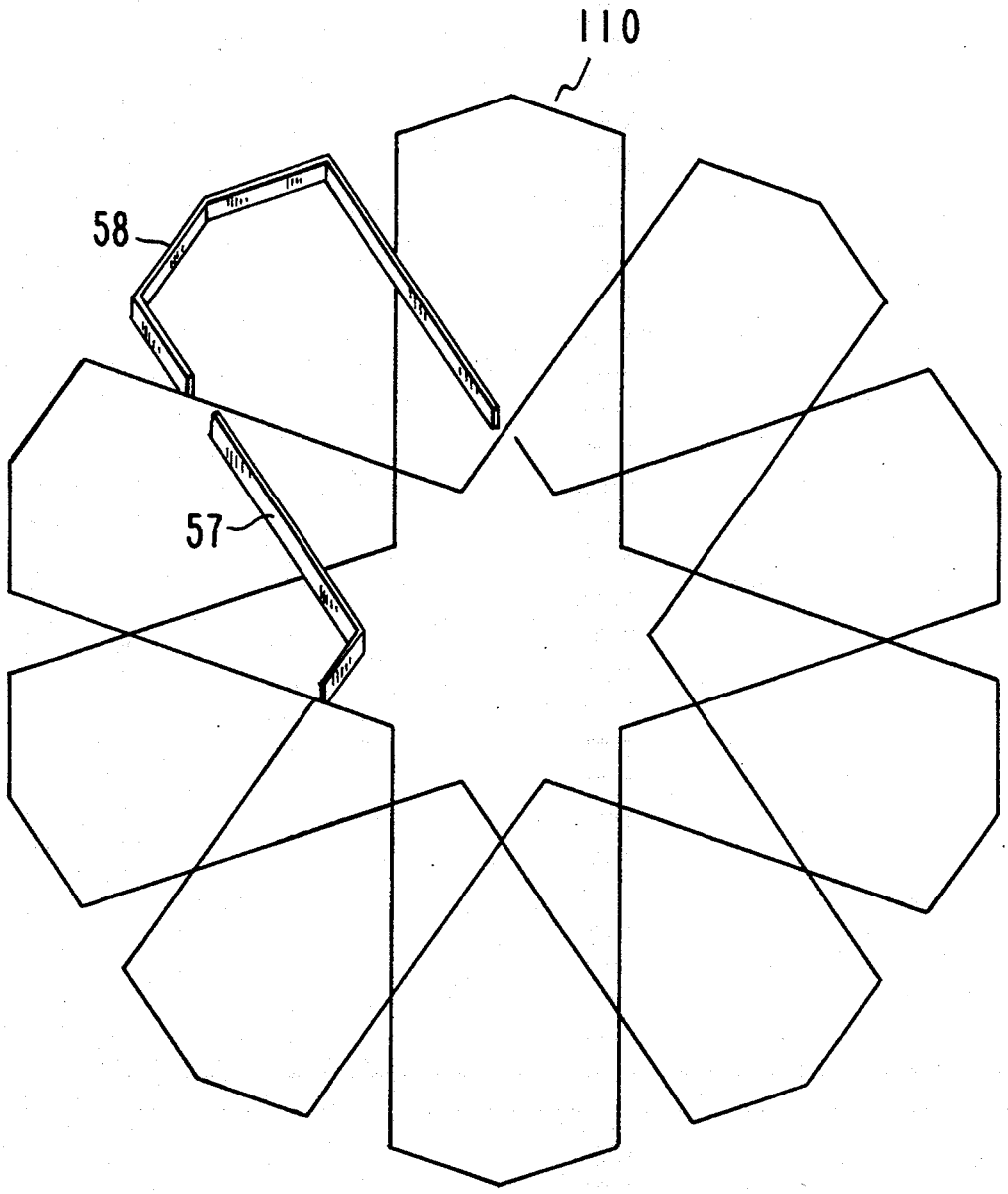
FIG. 23 is a top view of one pattern of a network of units also showing a perspective view of two units of the network of units of the pattern.

FIG. 23 is an example of a large ornamental figure whose production is facilitated by special units like those depicted in FIGS. 19, 20, 21 and 22. FIG. 23 shows a large figure (110) which is designed to cover a specific area. Highlighted lines (57) and (58) show the basic units needed to produce the design (110) depicted in FIG. 23. When the "U" shaped unit of FIG. 19 is used to make basic units (57) and (58), the units are assembled to make the ornamental figure. Colored concrete is then poured into the course formed by the "U" shaped unit. The colored concrete is preferably a different color than the color of the material poured into the cavities of the ornamental figure and on the rest of the floor.

Figure 24:
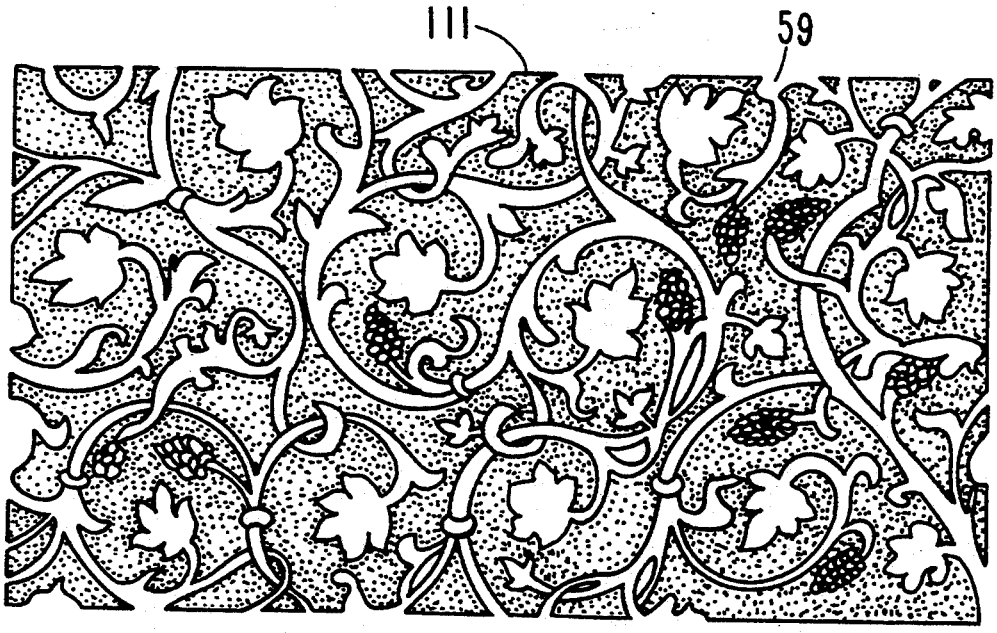
FIG. 24 is a top view of a two-color-concrete floor ornamented with the design of plants.

FIG. 24 demonstrates how the present invention may be used to make a floor (111) with ornamental designs of plants. The ornamental design (111) in FIG. 24 is made by utilizing units of the present invention wherein the cavities (59) formed by the units are filled with different colored material, such as colored concretes. The cavities (59) in FIG. 24 are represented in white and the floor in black. The top surfaces of the units form the lines outlining the plant design. Material of a color different from the color of the floor is poured into the cavities of the unit to make the plant design.

Figure 25:
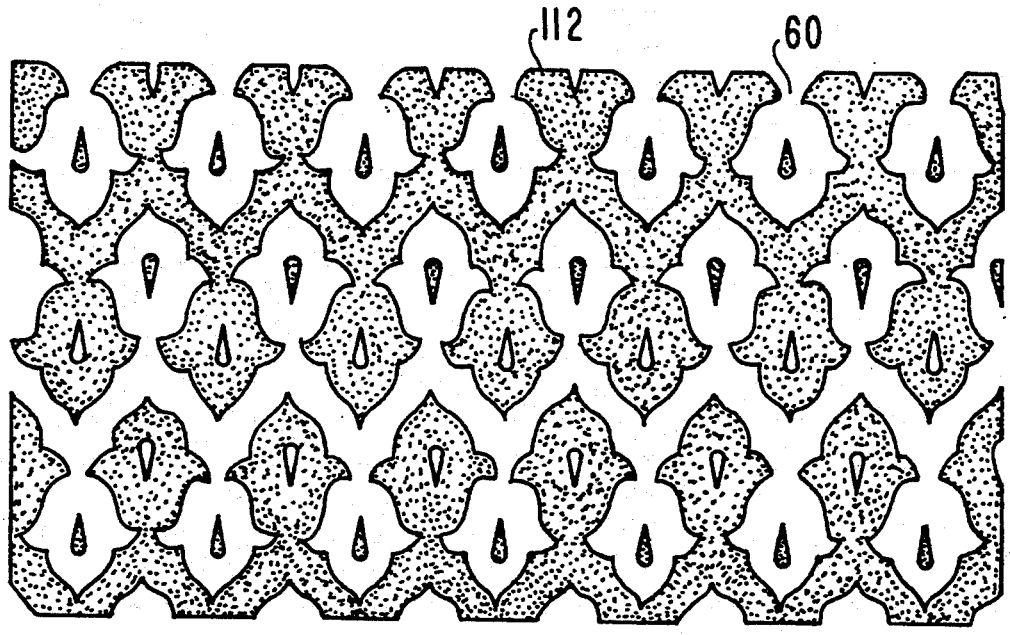
FIG. 25 is a top view of a two-color-concrete floor with an ornamental pattern.

FIG. 25 depicts another ornamental pattern (112) made possible by the present invention, in which the units make ornamental figures (60), shown in white, in a pattern similar to those found in oriental carpets. As in FIG. 24, material of a different color from that of the floor is poured into the cavities made by the units to make the ornamental pattern. Such an ornamental pattern cannot be made using any of the currently available methods described earlier in the specification. As these figures demonstrate, the present invention may be used to make an infinite number of simple or complex ornamental floor patterns and designs.

Figure 26:
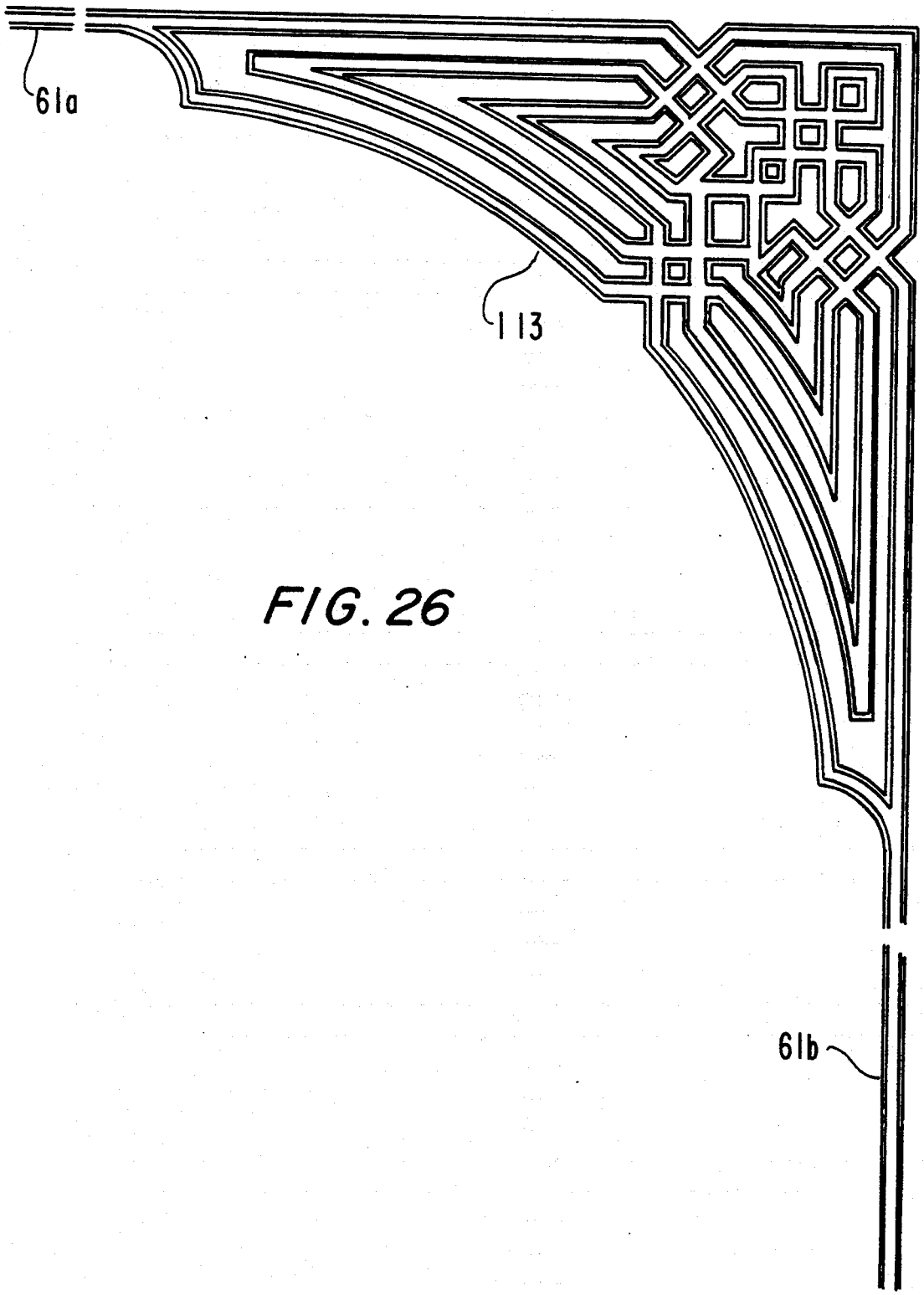
FIG. 26 is a top view of one unit used for ornamentation of a corner of a floor surface.

The present invention may also be used to make ornamental portions of a floor, such as corner ornamentation. FIG. 26 shows an example of a floor corner (113) made with a network of units of the present invention. One ornamental corner of a floor may be ornamentally connected to the other corners of the floor with special units like those shown in FIGS. 19 to 22. Such a connection is exhibited in FIG. 26 as units (61*a*) and (61*b*), long "U" shaped units. If a wider line is desired, then two parallel lines made from the units shown in FIGS. 20, 21 or 22 may be used in the manner previously described. Other types of units, other than the special units depicted in FIGS. 19 to 22, may also be used to connect the corners of a floor depending on the desired effect.

Figure 27A:
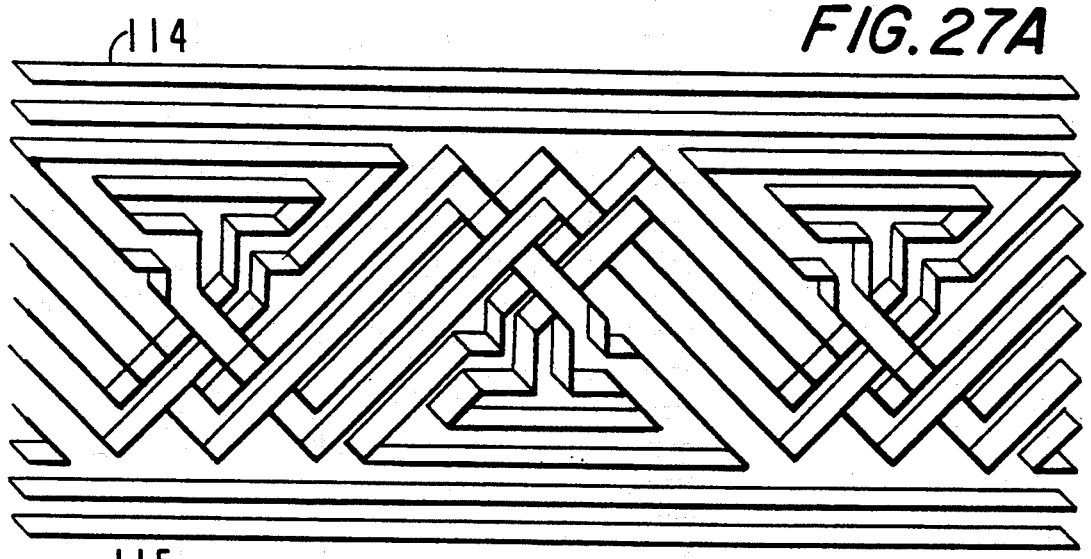
FIG. 27A–C are three top views of three different patterns of networks of units.
Figure 27B:
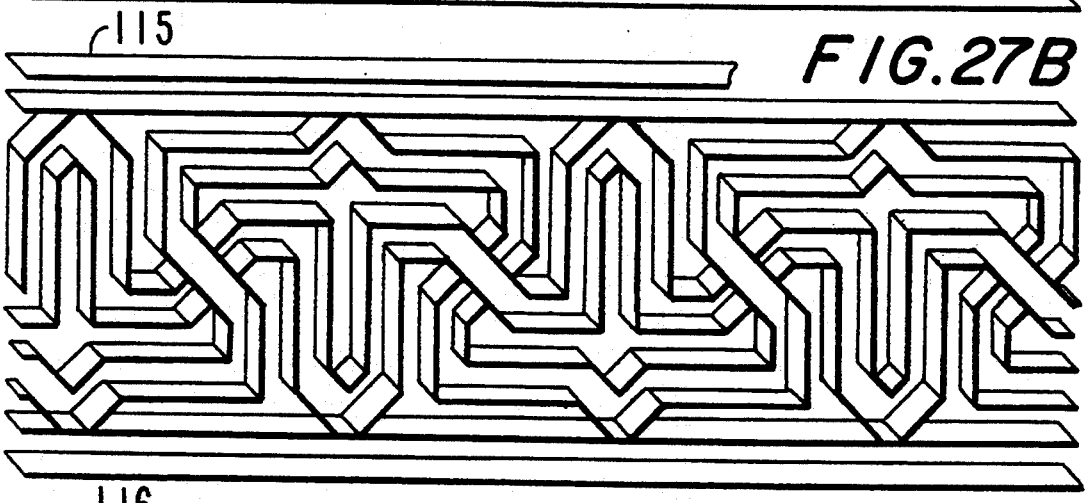
Figure 27C:
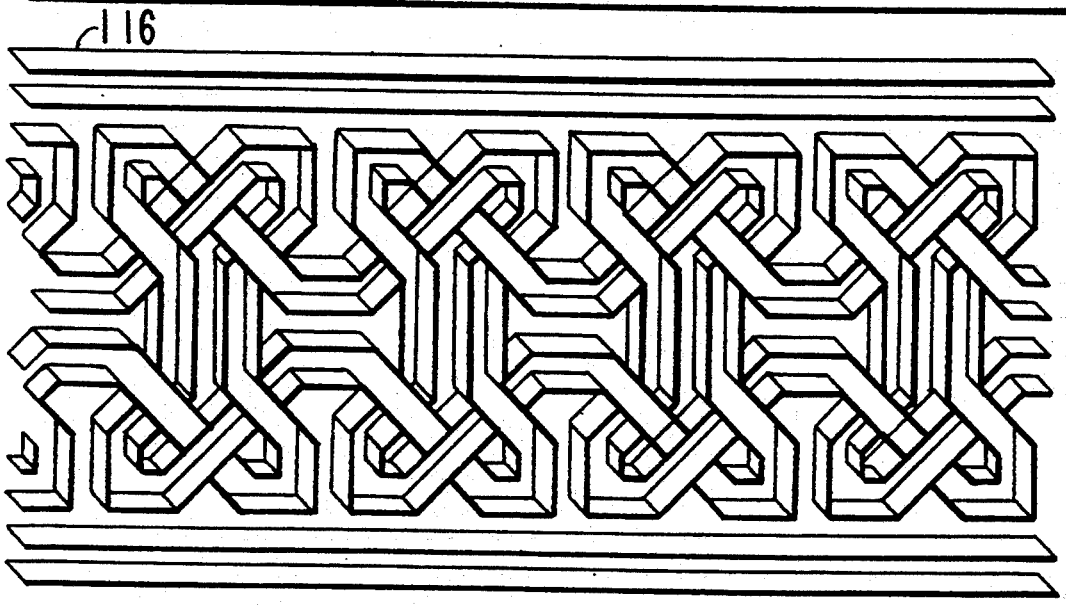

FIG. 27A–C shows three examples of different networks of units (114, 115, and 116, respectively) of the present invention which may be used for passageways, such as sidewalks, or to make decorative frames around the perimeter of a floor. Units are made comprising the same ornamental shape for the frame. The length of the unit is about 1.5 meters, the width is about 0.3 meters, and the height is about 0.3 meters. The units are assembled in a straight line to represent a continuous ornamental frame. The cavities are filled with concrete or other material along with the adjacent floor or passageway.

When ornamental designs are desired Which require more than one top surface of a unit to intersect at a given point, an assembly unit (62) of the present invention shown in FIG. 28 may be used to connect the units at the point of intersection. This use of the assembly unit (62) avoids the difficulty of passing two or more lines of the units into and through each other. The assembly unit has a top surface (63), a bottom surface (64), a side surface (65) and a plurality of slots (66). The slots extend from the top surface of the assembly unit at least partway down to the bottom surface. The width of the slots is equal to the width of the units being connected to the assembly unit. One embodiment of the assembly unit of the present invention is designed so that when units are connected to the assembly unit, the top surfaces of the units are higher than the top surface of the assembly unit. Additionally, the height difference between the top surfaces of the units and the top surface of the assembly unit is large enough to ensure that the material used to fill the cavity to the top surfaces of the units will cover and hide the assembly unit. However, if desired, the assembly unit of the present invention may be designed so that it is visible.

The assembly unit of the present invention serves a number of functions including stabilizing the network of units during pouring of the material into the cavities and ensuring uniformity of the ornamentation of a floor pattern by preventing any change in the angles of the intersections or in the inclination and separation of the lines of the units. The units may be connected and affixed to the assembly units by using an interference fit or simply by using glue. Assembly units of the present invention may be composed of a number of materials (including plastic) if they are covered by the material used to fill the cavities as the assembly unit will not be exposed to the environment.

The above description is meant to be illustrative only of the present invention, and not limiting thereof. Other variations of apparatus, method, and manufacture are well known to those skilled in the art and are meant to be included therein.

I claim:

1. An apparatus for constructing an ornamental surface, the ornamental surface comprising a repetitive ornamental pattern, the repetitive ornamental pattern comprising a first sub-pattern and a second sub-pattern, the first sub-pattern having a number of walls, the second sub-pattern having twice the number of walls of the first pattern, each of the walls of each pattern being substantially identical to the other walls of that pattern, the apparatus comprising:

a network of substantially identical non-connected units, each of the units having a top surface, a bottom surface, and two sides, each of the units being angled or arced at at least two locations lengthwise along the unit whereby a second lengthwise half of the unit is a mirror image of a first half of the unit, each unit comprising means arranged along the length of the unit for engaging that unit to the corresponding engaging means on at least one other unit, the engaging means positioned on each unit whereby each unit forms the wall of a first sub-pattern and the wall of a second sub-pattern when the network of units is assembled, the network of units cooperating to form the repetitive ornamental pattern with each wall of each sub-pattern comprising an angle or arc;

whereby the bottom surfaces of the network of non-connected units may be supported on a surface upon which the ornamental surface is to be constructed and the cavities filled with a material to form the ornamental surface contiguous with the top surfaces of the network of units.

2. A method for constructing an ornamental surface, the ornamental surface comprising a repetitive ornamental pattern, the repetitive ornamental pattern comprising a first sub-pattern and a second sub-pattern, the first sub-pattern having a number of walls, the second sub-pattern having twice the number of walls of the first pattern, each of the walls of each pattern being substantially identical to the other walls of that pattern, the method comprising the steps of:

a) providing a network of substantially identical non-connected units, each of the units having a top surface, a bottom surface, and two sides, each of the units being angled or arced at at least two locations lengthwise along the unit whereby a second lengthwise half of the unit is a mirror image of a first half of the unit, each unit comprising means arranged along the length of the unit for engaging that unit to the corresponding engaging means on at least one other unit, the engaging means positioned on each unit whereby each unit forms the wall of a first sub-pattern and the wall of a second sub-pattern when the network of units is assembled, the network of units cooperating when assembled to form the repetitive ornamental pattern with each of the walls of each sub-pattern being substantially identical to the other walls of that sub-pattern and each wall of either sub-pattern comprising an angle or arc, the sides of the units defining enclosed cavities corresponding to the first and second sub-patterns of the repetitive ornamental pattern;

b) assembling the network of units on the floor surface;

c) leveling the network of units;

d) affixing the network of units to the floor surface; and e) pouring a filling material into the cavities to the top of the network of units.

* * * * *